United States Patent [19]

Simmons et al.

[11] 4,123,876

[45] Nov. 7, 1978

[54] CASTING CUT-OFF MACHINE

[75] Inventors: John H. Simmons, Lyndhurst; Donald A. Daugherty, Euclid, both of Ohio

[73] Assignee: Precision Metalsmiths, Inc., Cleveland, Ohio

[21] Appl. No.: 751,261

[22] Filed: Dec. 16, 1976

[51] Int. Cl.[2] ..... B24B 19/00; B24B 23/08

[52] U.S. Cl. ..... 51/34 D; 51/37; 51/227 R; 83/411 R; 83/488

[58] Field of Search ..... 51/34 C, 34 D, 37, 98 R, 51/98.5, 216 ND, 227 R, 92 ND; 269/48.1; 83/411 R, 414, 487, 488

[56] References Cited

U.S. PATENT DOCUMENTS

| | | | |
|---|---|---|---|
| 963,603 | 7/1910 | Lunceford | 269/48.1 |
| 2,171,541 | 9/1939 | Crouch | 51/34 D |
| 3,233,888 | 2/1966 | Saha | 83/488 X |
| 3,878,654 | 4/1975 | Wendt | 51/37 X |
| 3,892,089 | 7/1975 | Coulstring | 51/37 X |
| 3,959,930 | 6/1976 | Hatta | 51/92 ND |

*Primary Examiner*—N. P. Godici

*Attorney, Agent, or Firm*—Watts, Hoffmann, Fisher & Heinke Co.

[57] ABSTRACT

An apparatus for cutting off castings from investment cast set-ups comprising a mandrel assembly engageable with the inside of the center tree of the set-up to clamp it with its longitudinal axis in a horizontal plane, a vertically movable carriage support, a carriage movable along the support parallel to the longitudinal axis of the center tree, a cut-off assembly including a horizontal abrasive disc on the carriage, and structure permitting lateral adjustment of the cut-off assembly in a direction normal to that of carriage movement.

10 Claims, 8 Drawing Figures

CASTING CUT-OFF MACHINE

BACKGROUND OF THE INVENTION

The present invention relates generally to the investment casting art, and more specifically to apparatus for severing castings from the center tree of an investment cast set-up.

It has been a conventional practice for many years to sever the castings from cast set-ups by an operation in which the set-up is held by the operator and pressed against a cut-off wheel to sever the casting gates. This operation is timeconsuming and is often cumbersome and difficult to carry out because of the weight and size of the set-up. In some instances, the set-ups are too heavy to handle and it is necessary to section the center tree longitudinally in a separate, additional operation.

The manual cut-off operation described above entails some risk to the operator because of metal chips, etc. Still other disadvantages are that the castings and/or the cut-off wheel can be damaged because of the difficulty of holding the set-up steady without twisting.

More recently, it has been proposed in U.S. Pat. No. 3,959,930 to provide a mechanized cut-off machine in an effort to eliminate some of the difficulties involved in manual operations. The machine disclosed in U.S. Pat. No. 3,959,930 comprises a fixture which clamps against the ends of the center tree to hold the set-up. The clamping fixture is secured to a movable mount driven by a motor actuacted feed screw. In operation, the set-up held by the clamping fixture is moved past a vertically disposed cut-off disc to sever the casting gates.

SUMMARY OF THE INVENTION

An object of the present invention is to provide a new cut-off machine for use in the investment casting art which overcomes certain disadvantages associated with the apparatus of the prior art.

The new cut-off apparatus comprises a mandrel assembly for holding a cast set-up with its longitudinal axis in a horizontal plane, a vertically adjustable carriage support, a carriage movable along the support parallel to the longitudinal axis of the set-up, a cut-off assembly including a horizontal abrasive disc or the like on the carriage, and structure for permitting lateral adjustment of the cut-off assembly in a direction normal to that of carriage movement.

In the preferred embodiment, the mandrel assembly comprises an expandable type mandrel adapted to engage the inside of the cast center tree. The preferred expandable-type mandrel assures clamping of the cast set-up so that the longitudinal axis of the center tree is in a horizontal plane, whereby the casting gates can be severed close to the castings without damaging them. The prior art proposal of clamping the ends of the center tree in a fixture could result in the axis of the tree being askew to the horizontal due to the fact that the end faces of the center tree often are not normal to its axis. This could in turn result in the castings being damaged by the cut-off disc as the tree is moved past it.

Another feature of the invention resides in the horizontal orientation of the cut-off disc so that it is positioned to sever the gates of the lowermost row of castings. As the gates are cut, the castings can fall unobstructed into a chute below the clamped workpiece. In the prior art proposal discussed above wherein the cut-off disc is arranged vertically at one side of the cast set-up, the severed castings may fall into the next row of castings on the set-up and have to be removed manually.

A further feature of the invention resides in the improved arrangement wherein the set-up is held in at a fixed location and the cut-off assembly moved past it. This arrangement eliminates the relatively massive fixture mount of the prior art, as well as the feed screw that was needed to move it. In the preferred embodiment of the present invention, the carriage is actuated smoothly and rapidly by an air cylinder and piston unit, and an associated hydraulic checking means, whereby the cut-off operation can be performed quickly with minimal wear of the abrasive cut-off disc.

Other features, advantages and a fuller understanding of the invention will be had from the following detailed description and the accompanying drawings.

DESCRIPTION OF PREFERRED EMBODIMENT

Figure 1:
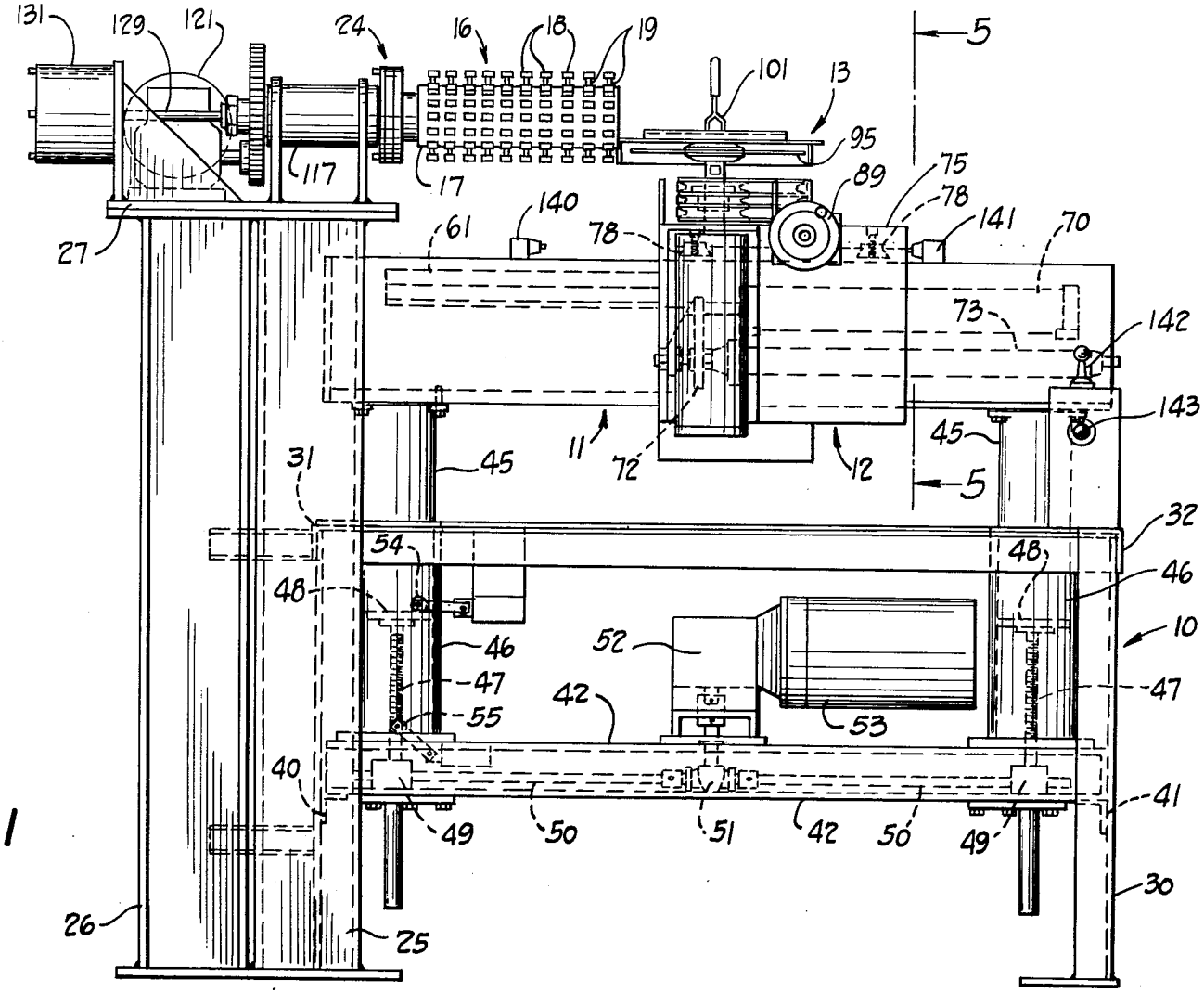
FIG. 1 is a side elevation of the apparatus according to the invention.
Figure 2:
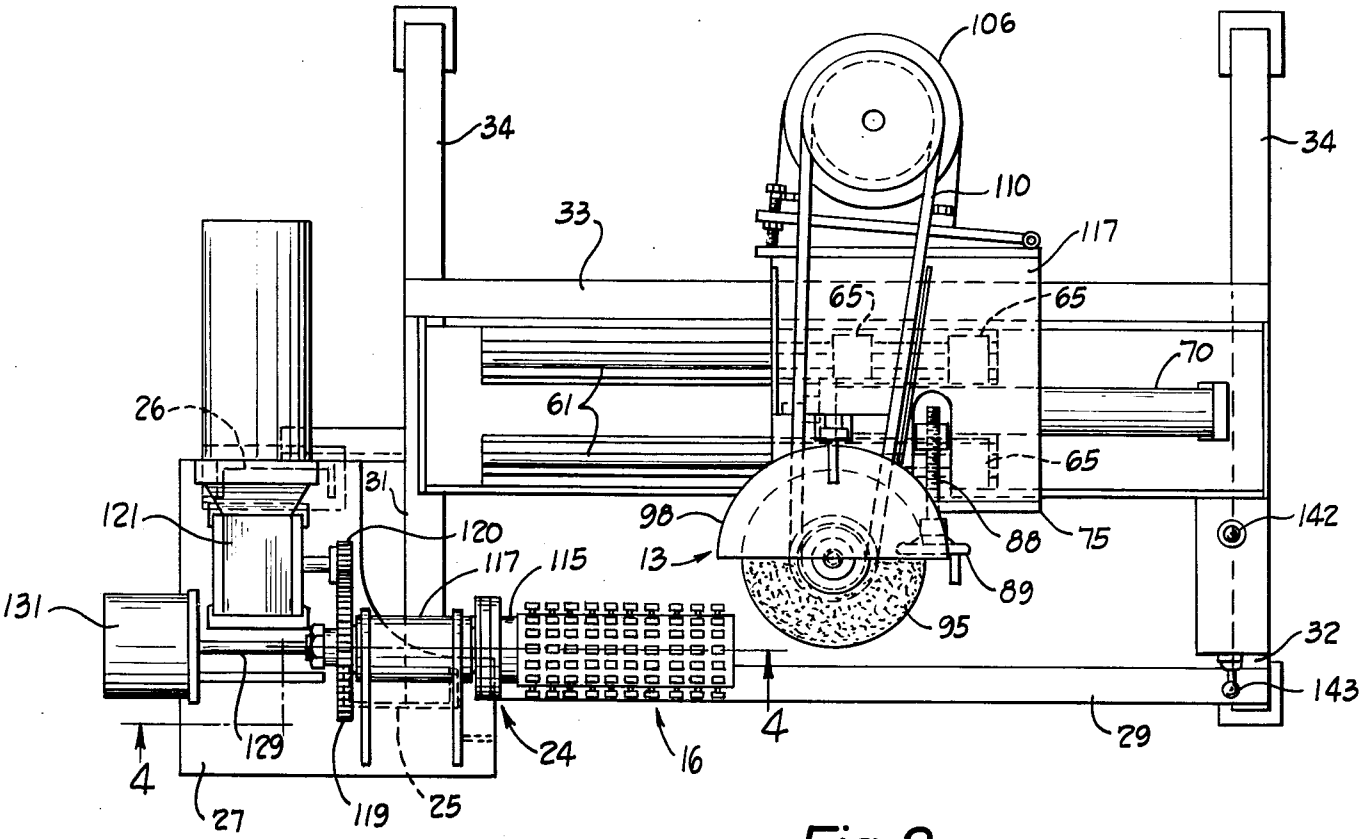
FIG. 2 is a top plan view of the apparatus of FIG. 1.
Figure 3:
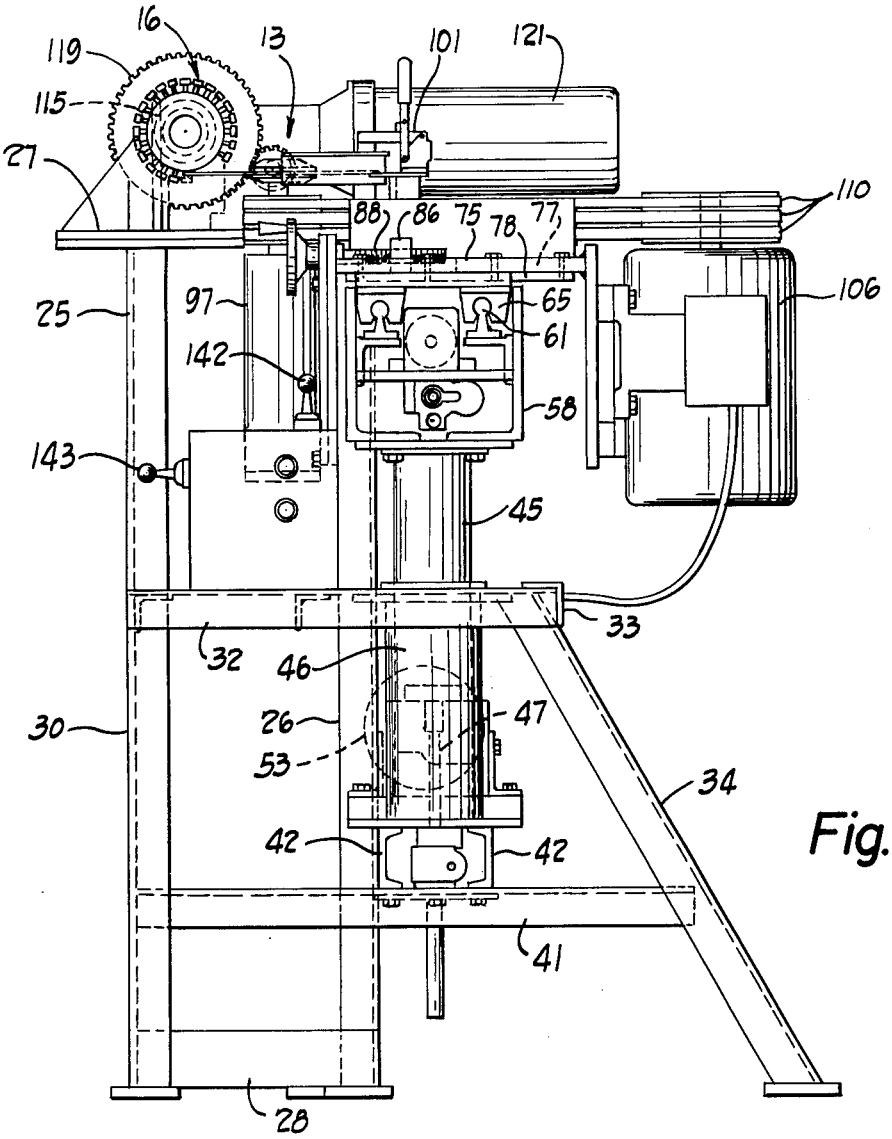
FIG. 3 is an end elevation of the apparatus of FIG. 1.

Referring to the drawings, and to FIGS. 1, 2 and 3 in particular, the cut-off machine of the present invention is shown to comprise a stationary frame 10 on which is mounted a vertically adjustable carriage support 11. A carriage 12 carries a cut-off assembly 13 and is movable along the carriage support 11.

Reference number 16 generally designates a typical investment cast set-up that comprises a tubular center tree 17 and longitudinal rows of castings 18 attached to the outside of the center tree 17 by gates 19. The cast set-up 16 is held by a mandrel assembly 24 over the carriage support 11 so that movement of the cut-off assembly along the carriage support is effective to sever the lowermost row of castings from the set-up in a manner to be described in more detail.

As shown, the frame 10 includes two vertical channel members 25, 26 that support a plate 27. The members 25, 26 are connected near their lower ends by a brace 28. A cross-beam 29 extends longitudinally from the member 25 to a vertical corner member 30 at the other end of the machine. The beam 29 forms part of a subframe that includes end members 31, 32 which extend from the members 25, 30, respectively, and are connected at their opposite ends by a member 33. Leg-forming members 34 extend down from the members 31, 32 at the ends of member 33. Another pair of end members 40, 41 are provided below the members 31, 32 and extend from the vertical members 25, 30 to the leg-forming members 34. The end members 40, 41 support a pair of adjacent cross-channels 42.

The carriage support 11 is mounted for vertical movement on a pair of posts 45 telescoped within cylinders 46. The cylinders 46 are mounted on the channels 42 and extend upwardly to the sub-frame formed by members 29, 31, 32, 33. Vertical movement is imparted to the posts 45 by a commercially available jacking mechanism comprising a translating screw 47 which extends into the bottom of each cylinder 46. A plate 48 is secured to the upper end of each screw 47 and is engagable with the bottom of the post 45. Each screw 47 is moved up and down by a nut and worm drive (not shown) in a housing 49. The two worms are keyed to cross shafts 50 that are driven through a gear box 51 and a gear reducer 52 by a motor 53. The upper and lower limits of travel of the carriage support 11 may be set by limit switches 54, 55, respectively, that are operatively contacted by the screw plates 48.

Figures 5, 6, 7:
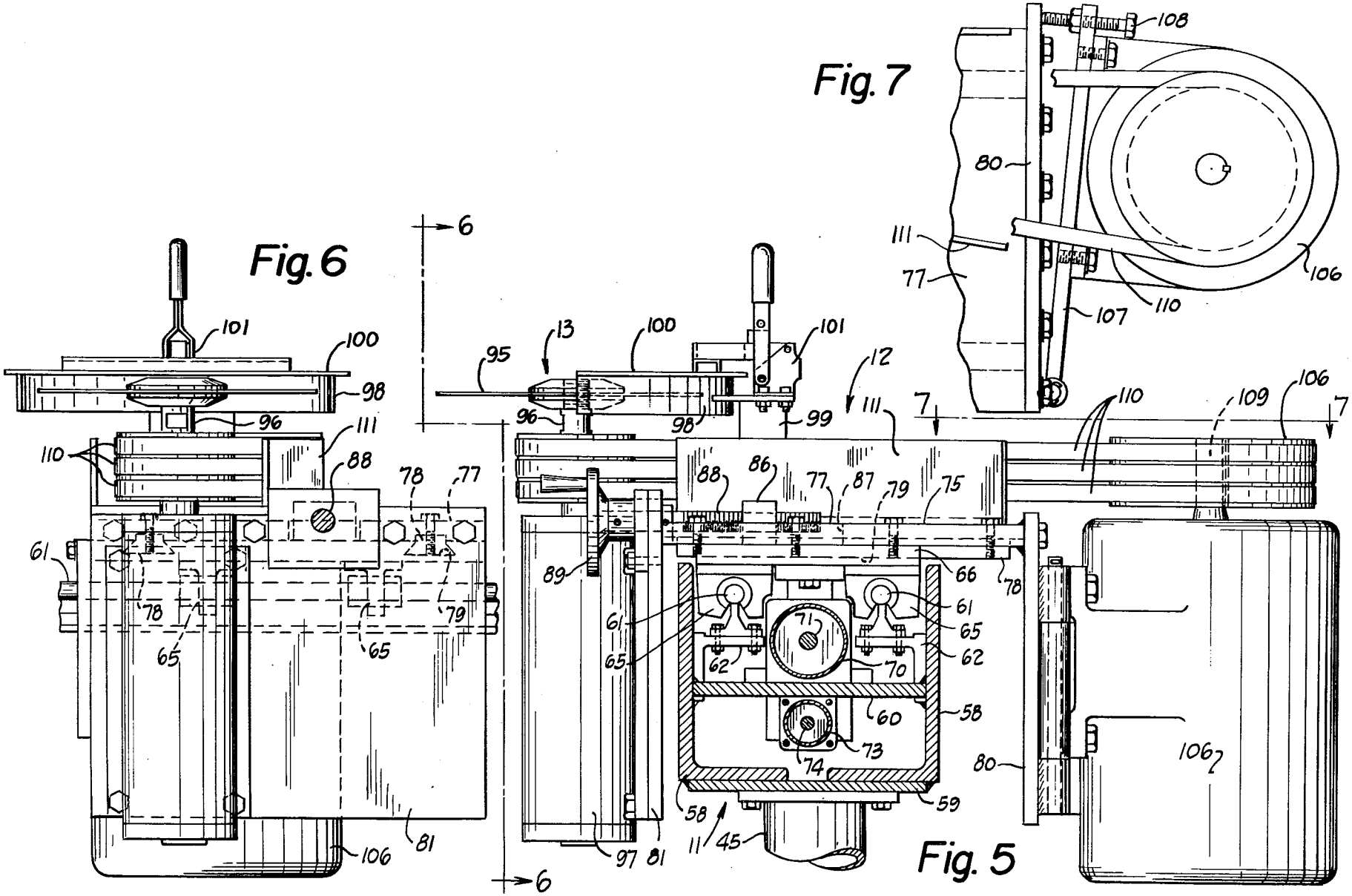
FIG. 5 is an enlarged, vertical cross-sectional view taken approximately on the line 5—5 of FIG. 1.
FIG. 6 is an end elevation taken approximately on the line 6—6 of FIG. 5.
FIG. 7 is a fragmentary plan view taken on the line 7—7 of FIG. 5.

Referring to FIG. 5, the carriage support 11 is further shown to comprise a pair of longitudinally extending, confronting angle members 58 welded to a plate 59 supported by the posts 45. A plate 60 is welded between the upstanding legs of the members 58 and extends part way along their lengths. The carriage 12 is movably supported by rails 61 located between the members 58 above the plate 60. The rails 61 are bolted to horizontal legs of angle members 62 welded to the members 58.

In the illustrated embodiment of the invention, the carriage 12 comprises two pairs of journal blocks 65 secured to the underside of a plate 66. The journal blocks 65 carry bearings (not shown), and each pair of blocks is engaged with one of the rails 61.

The actuating mechanism for reciprocating the carriage 12 along the rails 61 includes an air cylinder and piston unit 70 mounted on the cylinder support plate 60. The piston rod 71 of the unit 70 is connected to a metal tongue 72 depending from the plate 66. A hydraulic checking unit 73 is associated with the air cylinder and piston unit 70 in order to obtain precise, smooth control of the carriage. The unit 73 comprises an oil-filled cylinder bolted to the underside of the cylinder plate 60. A piston rod 74 extends from the oil cylinder and is connected to the metal tongue 72. When the air cylinder and piston unit 70 is actuated to move the carriage 12 toward the chuck assembly 24, the moving piston in the unit 73 forces oil through a transfer tube (not shown) and a needle valve into the rear of the unit. The rate of oil flow and hence the speed of the carriage 12 can be precisely controlled by adjusting the needle valve. On the return stroke, a suitable one-way valve in the piston of the unit 70 permits the oil to flow freely past the piston so that the carriage can be quickly returned to its original position.

A carriage subassembly 75 is supported by the main carriage plate 66 for adjustable lateral movement. As shown in FIGS. 5, 6. the subassembly 75 comprises a horizontal plate 77 which has dove-tail guides 78 bolted to its undersurface. The guides 78 are slidably received in correspondingly shaped ways 79 in the upper surface of the carriage plate 66. A motor mounting plate 80 is secured to one end of the plate 77 adjacent one of the carriage support members 58. A second mounting plate 81 is connected to the opposite end of the plate 77 adjacent the other carriage support member 58.

The carriage subassembly 75 is adjustable laterally of the plate 66 to compensate for wear of the cut-off disc of the assembly 13. In order to accomplish this movement, a nut 86 is fixed to the top of the carriage plate 66 and extends upwardly through a slot 87 in the plate 77 (FIGS. 2 and 5). An adjustment screw 88 is threaded through the nut 86 and extends lengthwise of the slot 87. The screw 87 is rotatably journalled through the plate 81 and may be provided with a hand actuatable adjusting wheel 89.

The cut-off assembly 13 includes an abrasive disc 95. The disc 95 is suitably clamped to a vertical shaft 96 rotatably mounted in a housing 97 bolted to the face of the plate 81. A semi-circular guard housing 98 is provided around part of the disc 95. The housing 98 is secured to a post 99 extending upwardly from the plate 77. In the illustrated embodiment, the disc 95 is made accessible for replacement by removal of a top plate 100 of the housing 98. The plate 100 can be moved to an open position by actuation of a quick release mechanism 101.

The cut-off disc 95 is driven by a motor 106. As shown in FIGS. 6 and 7, the motor 106 is connected to the plate 80 by a motor mount 107 including an adjustment screw 108. The disc shaft 96 and the motor shaft 109 carry pulleys that are interconnected by belts 110. A belt guard 111 is shown adjacent the belts on the plate 77.

Figure 4:
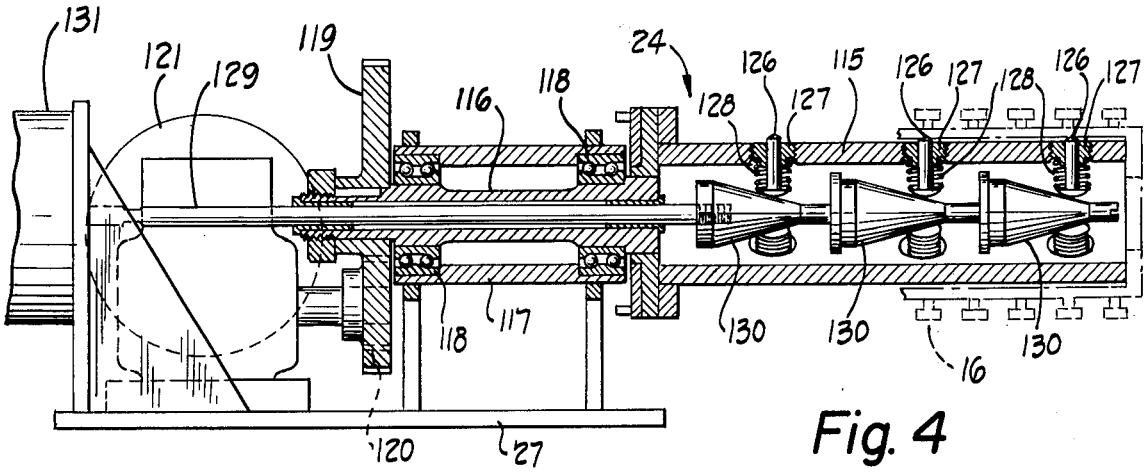
FIG. 4 is an enlarged view, partially in cross-section of the mandrel assembly.

The mandrel assembly 24 for holding the workpiece or cast set-up 16 is best shown in FIG. 4. The assembly comprises a rotatably indexible, expandable mandrel 115 secured to the end of a hollow spindle 116. The spindle 116 is journalled by bearing assemblies 118 in a housing 117 mounted on the plate 27. One end of the spindle 116 extends from the housing 117 and is provided with a gear 119. The gear 119 is engaged by a drive gear 120 on the shaft of a motor 121 supported on the plate 27.

A plurality of radially movable pins 126 in the mandrel 115 extend through holes 127 for engagement with the inside of the tubular center tree 17. Springs 128 are provided around the pins for urging them radially inwardly of the mandrel 115. The pins 126 can be pressed outwardly into work-engaging position by actuation of a reciprocal rod 129 extending through the hollow spindle 116. The rod 129 carries conical cam members 130 that coact with the inner ends of pins when the rod is moved to the right as viewed in FIG. 4. The rod 129 is selectively actuated by a piston-cylinder unit 131 on the plate 27.

In operation a cast set-up is engaged over the mandrel 115 and the piston-cylinder unit 131 is actuated to press the pins 126 radially outwardly against the inner surface of the center tree 17 and hold the set-up in the manner shown in FIG. 1. It will be apparent that the action of the pins 126 will be effective to hold the set-up so that its longitudinal axis is in a horizontal plane parallel to the axis of the mandrel 115 and the direction of movement of the carriage 12, whereby the casting gates can be close to the castings without damaging them.

Figure 8:
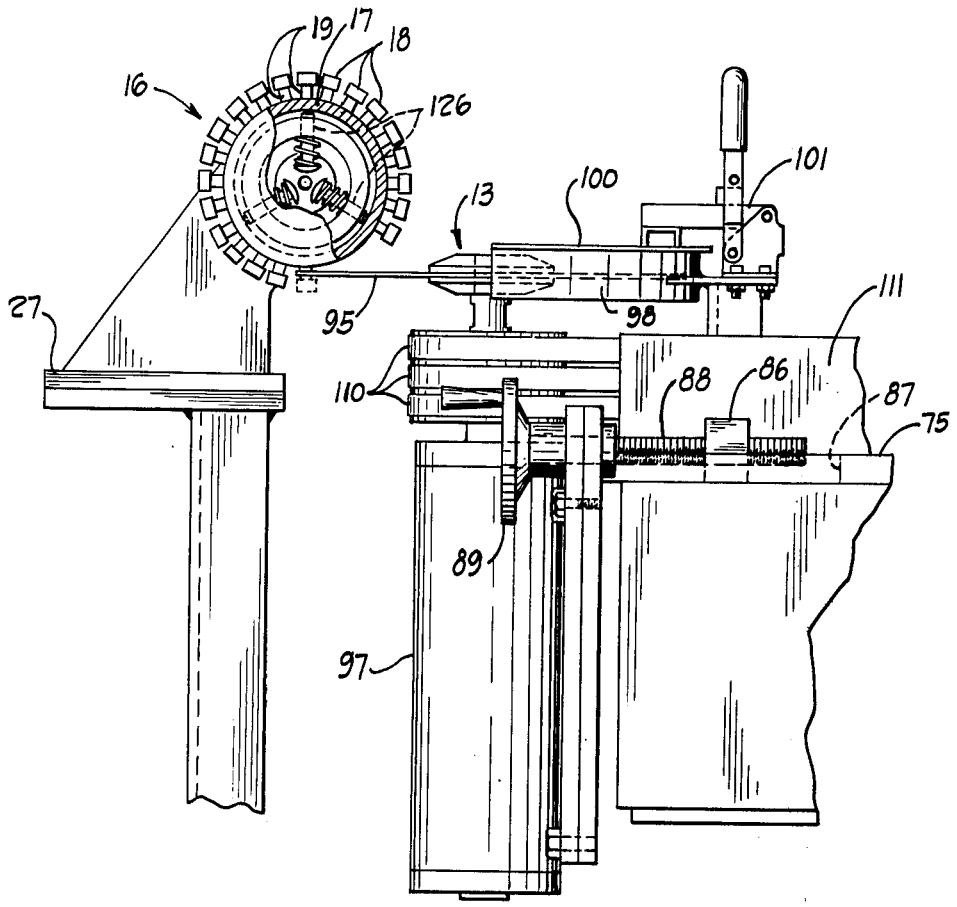
FIG. 8 is a fragmentary, enlarged elevational view of a portion of the apparatus.

With the cast set-up 16 clamped over the mandrel 115, the cut-off disc 95 is positioned as shown in FIG. 8 to cut through the gates 19 of the lowermost row of castings 18. Positioning of the cut-off disc is accomplished by actuating the motor 53 to elevate the carriage support 11 and turning the handwheel 89 to laterally adjust the carriage subassembly 75. In the case of cast set-ups having closely spaced rows of castings, one or more rows can be removed manually to afford clearance for the cut-off disc before clamping the set-up on the machine.

The air cylinder and piston unit 70 is then actuated to move the carriage 12 along the support 11 toward the set-up 16 and thereby sever the lowermost row of castings. The castings which are severed fall away from the set-up into a chute (not shown) which funnels the castings into a suitable tray or bin. When the carriage 12 reaches the limit of its travel which may be set by a limit switch 140, the actuating unit 70 is reversed to return the carriage to its start position set by a limit switch 141. The mandrel 115 then may be indexed by actuation of the motor 121 to bring the next row of castings on the set-up into position be severed as described above.

Actuation of the various motors can be accomplished in any suitable manner. For example, an actuating switch 142 (FIG. 3) at one end of the machine may be arranged in fluid circuit relation with a reversing valve (not shown) for the air cylinder and piston unit 70, whereby forward and reverse movement of the switch 142 will cause forward and reverse movement of the carriage 12. The same switch 142 may be placed in circuit relation to the indexing motor 121, whereby lateral movement of the switch will selectively index the mandrel 115 in either direction of rotation. A switch 143 may be provided in circuit relation with the motor 53 for raising and lowering the carriage support 11. A foot switch (not shown) may be provided in circuit relation with the cylinder unit 131 for actuating the mandrel pins 126.

Many variations and modifications of the invention will be apparent to those skilled in the art in light of the foregoing disclosure. Therefore, it is to be understood that, within the scope of the appended claims, the invention can be practiced otherwise than as specifically shown and described.

What is claimed is:

1. Apparatus for severing metal pieces from a member comprising:

(a) a frame, (b) a mandrel assembly on said frame for holding said member with its longitudinal axis in a horizontal plane, (c) a vertically adjustable carriage support on said frame, (d) carriage means movable along said support, and (e) a cut-off assembly on said carriage means including cut-off means below said mandrel assembly, (f) said carriage means including means for laterally adjusting said cut-off assembly in a direction normal to that of carriage movement.

2. Apparatus as claimed in claim 1 wherein said mandrel assembly comprises a rotatably indexible mandrel including radially movable, work-engaging means.

3. Apparatus for severing metal pieces from a common member comprising:

(a) a frame, (b) a mandrel assembly on said frame for holding the member with its longitudinal axis in a first horizontal plane, (c) vertically adjustable carriage support means on said frame, (d) elevating means for selectively adjusting the height of said support means, (e) carriage means movable on said support means, (f) a cut-off assembly on said carriage means including cutting means lying in a second horizontal plane below said first plane, and (g) actuating means for reciprocating said carriage means.

4. Apparatus as claimed in claim 3 wherein said mandrel assembly comprises a rotatably indexible, expandable mandrel.

5. Apparatus as claimed in claim 3 wherein said elevating means comprises motor driven feed screw means for raising and lowering said carriage support.

6. Apparatus as claimed in claim 3 wherein said actuating means comprises an air cylinder and piston unit and a hydraulic checking means.

7. Apparatus as claimed in claim 3 wherein said carriage means includes means for laterally adjusting said cut-off assembly in a direction normal to that of carriage movement.

8. Apparatus for severing metal castings from the center tree of an investment cast set-up comprising:

(a) a frame, (b) a mandrel assembly on said frame including a rotatably indexible, expandable mandrel, (c) vertically elevatable carriage support means on said frame including horizontal rails below said mandrel, (d) elevating means for raising and lowering said carriage support means, (e) carriage means movable on said rails and including a laterally adjustable carriage subassembly movable in a path normal to said rails, (f) actuating means for reciprocating said carriage means, and (g) a cut-off assembly on said carriage subassembly including cutting means arranged in a horizontal plane below said mandrel.

9. Apparatus as claimed in claim 8 wherein said mandrel includes a plurality of radially movable pins engagable with the inside of the center tree of a cast set-up.

10. Apparatus as claimed in claim 8 wherein said actuating means comprises an air cylinder and piston unit and hydraulic checking means connected to said unit.

* * * * *